United States Patent [19]

Takeuchi

[11] 4,225,146

[45] Sep. 30, 1980

[54] DEVICE FOR EXERCISING INFANT IN WALKING

[75] Inventor: Kazutsugu Takeuchi, Tokyo, Japan

[73] Assignee: Takeuchi Press Limited Company, Tokyo, Japan

[21] Appl. No.: 944,026

[22] Filed: Sep. 20, 1978

[30] Foreign Application Priority Data

Apr. 19, 1978 [JP] Japan ..... 53-52666

[51] Int. Cl.[3] ..... A47D 13/04

[52] U.S. Cl. ..... 280/87.02 W; 108/115; 248/439; 272/70.3; 280/87.05; 297/5; 403/108

[58] Field of Search ..... 272/70, 70.3; 403/107, 403/108, 94, 102; 108/115, 127; 248/188.6, 166, 439, 434, 435; 297/5, 6, 274; 280/87.02 W, 87.05

[56] References Cited

U.S. PATENT DOCUMENTS

| | | | |
|---|---|---|---|
| 1,406,881 | 2/1922 | Lorenzen | 403/107 |
| 1,751,661 | 3/1930 | Schaefer | 403/107 |
| 3,096,963 | 7/1963 | Welsh | 248/439 X |
| 3,504,927 | 4/1970 | Seki | 272/70.3 X |
| 3,796,430 | 3/1974 | Sudo | 272/70.3 |
| 4,140,311 | 2/1979 | Murakami | 272/70.3 |

FOREIGN PATENT DOCUMENTS

| | | | |
|---|---|---|---|
| 1403489 | 5/1965 | France | 403/108 |
| 423363 | 4/1967 | Switzerland | 403/108 |

*Primary Examiner*—Richard C. Pinkham
*Assistant Examiner*—Arnold W. Kramer
*Attorney, Agent, or Firm*—Oblon, Fisher, Spivak, McClelland & Maier

[57] ABSTRACT

A device for exercising an infant while walking characterized in that connection metal fittings having open outer sides are fastened to an upper portion of right and left side rods which constitute resilient lower legs formed in a V-shape, hooking holes formed on the opposing side walls of said right and left connection metal fittings in the vertical direction maintaining a distance between the upper and lower legs, said hooking holes being communicated by a path narrower than the diameter of said hooking holes. A horizontal rod of an upper leg folded in a U-shape is inserted in said right and left connection metal fittings. Hooking rods which fit into the hooking holes are attached to the right and left side portions of said horizontal rod thereby to construct a leg member, and the thus constructed leg member is fitted to a plate ring having wheels and to a table plate on which is mounted a saddle.

1 Claim, 4 Drawing Figures

DEVICE FOR EXERCISING INFANT IN WALKING

BACKGROUND OF THE INVENTION

1. Field of the Invention

This invention is related to a device for exercising infants while walking, and its object is to provide a device for exercising an infant while walking, which permits the length of the leg member to be suitably varied so that the height from the floor surface to the saddle can be freely adjusted to attain a height suited for the stature of an infant, and which is very convenient for being packaged.

2. Description of the Prior Art

The leg member connecting the plate ring and the table plate employed by the conventional devices for exercising infants while walking, of this sort, were so constructed as to be folded only at one portion, making it difficult to adjust the length of the leg member.

Devices for providing exercise while walking will provide their function of exercise only when the feet of an infant are allowed to touch the floor surface. However, since the aforementioned prior art leg members did not permit their lengths to be varied, the height could be adjusted only by adjusting the saddle mounted on the table plate.

With the abovesaid conventional devices in which the distance between the floor surface and the table plate is fixed, however, the upper half body of the infant was raised far above the table plate when the saddle was raised, presenting the liklihood of a fall.

Conversely, when the saddle was lowered, the upper half body of the infant was located below the table plate with only the head being protruded thereabove, thereby giving the infant a very unnatural and narrow feeling.

A device was proposed in Japanese Utility Model Publication No. 36438/73 which is capable of adjusting the length of the leg member thereby eliminating the aforementioned inconveniences and defects. The device of this utility model publication, however, was designed to be folded only at a portion of holes formed on both side walls of the cylinder plate; therefore the restricted folding portions could not help to greatly reduce the bulkiness of the device at the time of packaging. Further, the portions engaging with the holes of the cylindrical plates were made of folded edges bent outwardly beyond the resilient metal rods. To change the engaging positions with respect to the holes, therefore, the metal rod had to be gripped by hand to pull the folded edge completely out of the hole and to fit it to a selected hole. With such a device, therefore, the resilient metal rod was often disengaged from the cylindrical plate at the time of changing the height, making it difficult to smoothly handle the device.

SUMMARY OF THE INVENTION

An object of this invention therefore is to eliminate the aforementioned inconveniences and defects while walking characterized in that connection metal fittings having open outer sides are fastened to an upper portion of right and left side rods which constitute resilient lower legs formed in a V-shape, hooking holes formed on the opposing side walls of said right and left connection metal fittings in the vertical direction maintaining a distance between upper and lower legs, said hooking holes being communicated by a path narrower than the diameter of said hooking holes. A horizontal rod of an upper leg folded in a U-shape is inserted in said right and left connection metal fittings. Hooking rods which fit into the hooking holes are attached to the right and left side portions of said horizontal rod thereby to construct a leg member and the thus constructed leg member is fitted to a plate ring having wheels and to a table plate on which is mounted a saddle.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several views, and wherein.

DETAILED DESCRIPTION OF THE PREFERRED EMBODIMENTS

Figure 1:
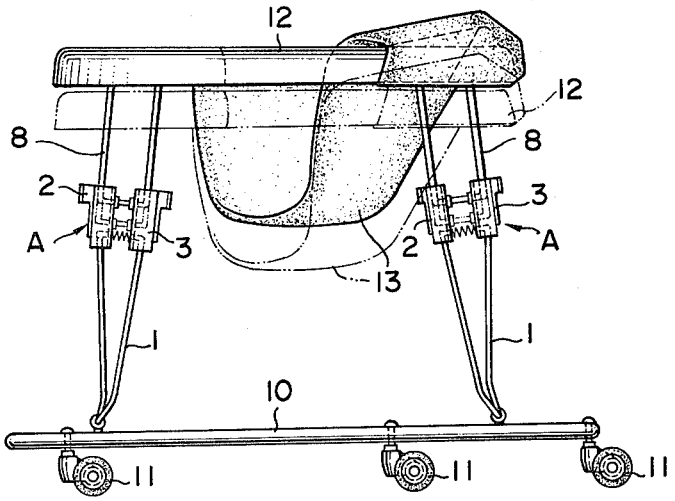
FIG. 1 is a front view of the device.

An embodiment of the invention is illustrated with reference to the drawings. The device for exercising an infant while walking consists of a plate ring 10 having wheels 11 such as casters, a table plate 12 having a through hole and a saddle 13 mounted on the lower portion of the through hole and a foldable leg member A connecting the plate ring 10 to the table plate 12, wherein the leg member A is made up of a lower leg 1, an upper leg 8 and connection metal fittings 2 and 3 for connecting said lower leg 1 and said leg 8. The open ends of the lower leg 1 are attached to the plate ring 10, and the open ends of the upper leg 8 are attached to the table plate 12.

Figure 2:
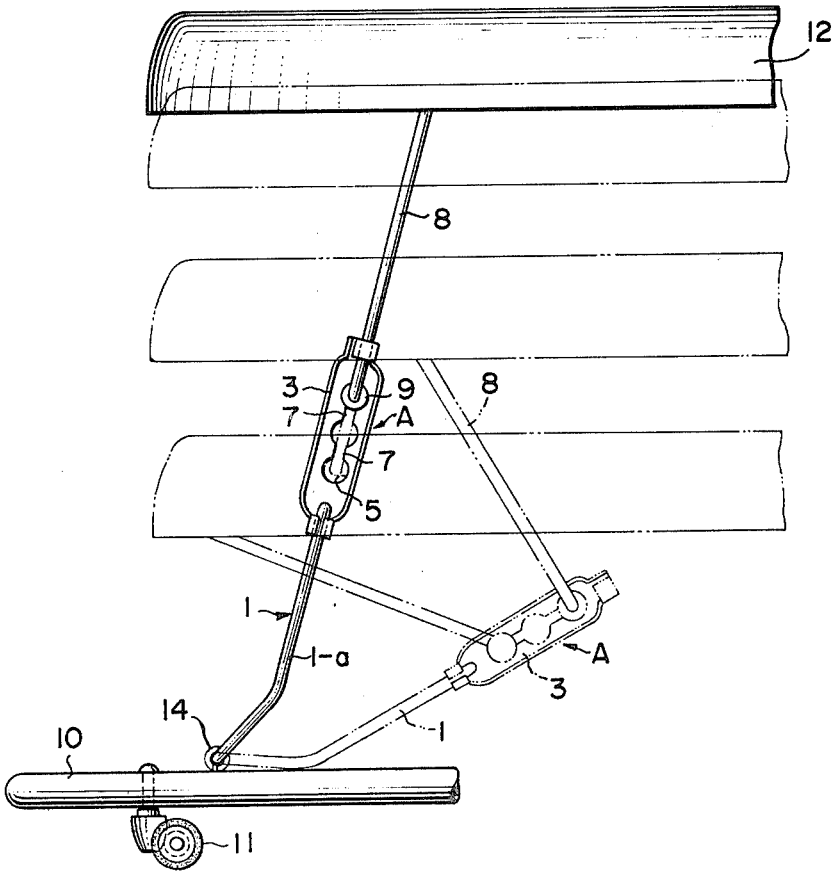
FIG. 2 is a diagram showing a major portion on an enlarged scale.
Figure 3:
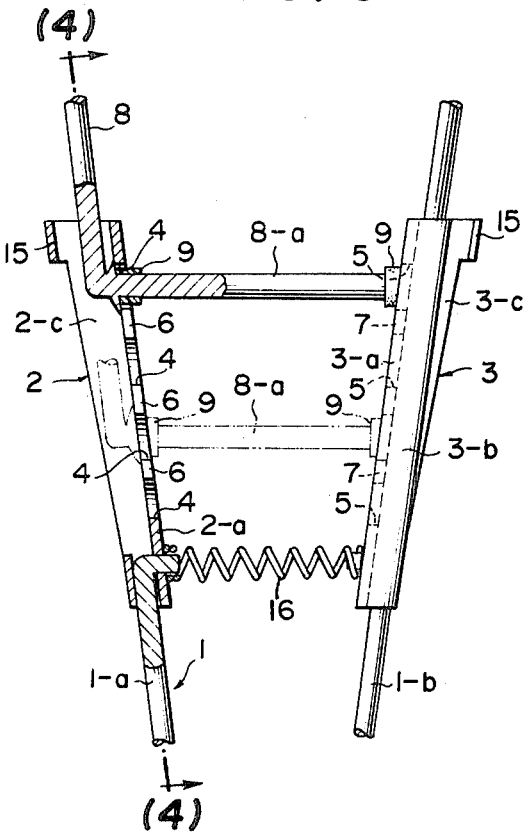
FIG. 3 is a front view showing a major portion on an enlarged scale in a partly cut-away manner.
Figure 4:
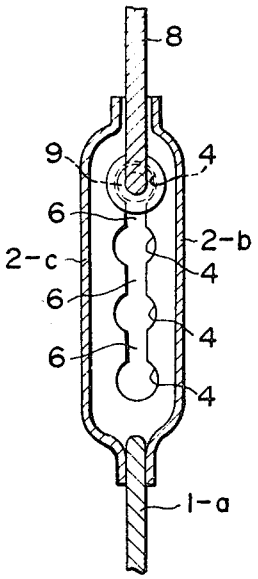
FIG. 4 is a cross-sectional view along the line 4—4 of FIG. 3.

The leg member A is illustrated in more detail in FIGS. 2 through 4. The lower legs 1 are made of metal rods and curved in a V-shape. To the curved portions are attached support rings 14 which will be mounted on the plate ring 10, and to the upper ends of the right and left side rods 1*a* and 1*b* are fastened the connection metal fittings 2 and 3 in a unitary structure, such that said connection metal fittings may be moved so as to reduce the distance therebetween by gripping the lower legs 1.

The connection metal fittings 2 and 3 are made of a metal plate and formed in a ]-shape with the outer side being open. In the opposing side walls 2*a* and 3*a* of the right and left connection metal fittings 2 and 3 are formed a plurality of hooking holes 4 and 5 in an opposed manner maintaining a constant distance between the upper and lower legs in a vertical direction. The hooking holes 4 and 5 are communicated by paths 6 and 7 of a width narrower than the diameter of said hooking holes 4 and 5.

That is, the width of the paths 6 and 7 communicating the hooking holes 4 and 5 is slightly greater than the diameter of a metal rod forming the upper leg 8 which will be mentioned later, so that said upper leg 8 can be smoothly slid in the vertical direction and the hooking holes 4 and 5 have a diameter greater than the width of the passages 6 and 7 so that the sliding upper leg 8 can be reliably placed in position.

On the outer upper portion of the connection metal fittings 2 and 3 are projected engaging pieces 15 directed toward the front from the rear walls *2c, 3c.* They maintain an appropriate distance between the side and end of the front walls *2b, 3b,* i.e. maintain a distance wider than the diameter of the metal rod forming the upper leg 8, whereby when the lower legs 1 are gripped by hand, the engaging pieces 15 restrict the moving range of the connection metal fittings 2 and 3 that move toward each other, so that the upper leg 8 can be smoothly turned and folded.

The upper leg 8, like the lower leg 1, is made of a metal rod folded in a U-shape, and the upper ends of the right and left rods are attached to the table plate 12. To the right and left sides of the horizontal rod 8*a* are fitted hooking rods 9 that will fit to the hooking holes 4 and 5.

As shown in the drawings, the hooking rod 9 consists of a metal pipe having an inner diameter nearly equal to the diameter of the upper leg 8, or a strap of metal which is wound and melt-adhered. What is important is that the hooking rod 9 has a diameter larger than the upper leg 8 and can be fitted to the hooking holes 4 and 5.

Further, the shape of the hooking rod 9 and the hooking holes 4, 5 need not be limited to a circular shape, but may be of a square shape. When formed in a square shape, however, the device cannot be assembled from the folded state simply by turning the upper leg 8. That is, the lower legs 1 must be gripped to disengage the hooking rod 9 from the hooking holes 4 and 5, the upper leg 8 is then so turned that it is in alignment with the lower legs 1 and then the upper leg 8 is fitted to the selected hooking holes 4 and 5 along the paths 6 and 7.

Therefore, to fold the aforesaid leg member A, the lower legs 1 are gripped and narrowed, whereby the hooking holes 4 and 5 of the connecting metal fittings 2 and 3 are disengaged from the hooking rods 9 of the upper leg 8 and located at a position of the horizontal rod 8*a* having a diameter smaller than that of the hooking rods 9, so that the upper leg 8 can be turned and folded.

The leg member A can be turned and folded not only at the hooking holes 4 and 5 but also in the paths 6 and 7 communicating the hooking holes 4 and 5.

Furthermore, if the lower legs 1 are gripped to narrow the distance between the right and left connection metal fittings 2 and 3, the upper leg 8 is allowed to slide in the vertical direction along the right and left hooking holes 4, 5 and the paths 6, 7; the upper leg 8 can be hooked to any desired hooking holes 4 and 5, so that the length of the leg member A can be adjusted.

In the drawings, reference numeral 16 represents a spring which resiliently presses the connection metal fittings 2 and 3 attached to the right and left side rods 1*a,* 1*b* of the lower legs 1, so that the right and left connection metal fittings 2 and 3 are always urged outwardly to maintain an intimately hooked state with respect to the upper leg 8.

Being constructed as mentioned above, the upper leg is allowed to be folded at the hooking holes formed in the connection metal fittings. In addition, the upper leg can be folded not only at the hooking holes but also in the paths communicating the hooking holes.

Accordingly, the device of the present invention can be folded depending upon the size of the packageing boxes so as not to be bulky, thereby providing great convenience.

Further, in folding or adjusting the leg member, the upper leg can be slid very smoothly along the paths.

Besides, since the upper leg and the lower leg are always connected by means of the connection metal fittings, the upper leg is never removed from the metal fittings at the time of folding and changing the position of the device, thereby providing very enhanced safety performance.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for exercising an infant while walking characterized in that a left and right connection metal fitting having an open outer side is fastened to a respective upper portion of right and left side rods which constitute resilient lower legs formed in a V-shape, a plurality of upper leg hooking holes formed on the opposing side walls of said right and left connection metal fittings in the vertical direction maintaining a distance between the upper and lower legs, said hooking holes being communicated by a path narrower than the diameter of said hooking holes, a horizontal rod of said upper leg folded in a U-shape is inserted in said right and left connection metal fittings, hooking rods approximately the size of said hooking holes which fit into the hooking holes are attached to the right and left side portions of said horizontal rod thereby to construct a leg member which is vertically adjustable by pressing the connection metal fittings towards each other so as to free the hooking rods from the hooking holes whereby the horizontal rod can be moved in the communicated path between hooking holes, and whereby the legs can be folded when the hooking rods are disengaged from said hooking holes, and means to prevent folding when the hooking rods are inserted in the hooking holes, and the thus constructed leg member is fitted to a plate ring having wheels and to a table plate on which is mounted a saddle.

* * * * *